United States Patent [19]

Yoichi

[11] 4,041,734

[45] Aug. 16, 1977

[54] DEVICE FOR SUPPORTING AND GUIDING KNITTING NEEDLES FOR KNITTING MACHINES

[76] Inventor: Inamoto Yoichi, No. 13 3-chome, Nagar-Naka-doori, Ooyodo, Osaka, Japan, 531

[21] Appl. No.: 688,660

[22] Filed: May 21, 1976

[30] Foreign Application Priority Data

June 6, 1975 Japan ..... 50-68809

[51] Int. Cl.[2] ..... D04B 15/00

[52] U.S. Cl. ..... 66/115

[58] Field of Search ..... 66/115, 38, 114

[56] References Cited

U.S. PATENT DOCUMENTS

| | | | |
|---|---|---|---|
| 1,115,140 | 10/1914 | Williams | 66/115 |
| 2,814,189 | 11/1957 | Crouch | 66/115 |
| 2,873,595 | 2/1959 | Shortland | 66/115 |
| 3,141,314 | 7/1964 | Lyster | 66/115 X |
| 3,257,828 | 6/1966 | Greczin | 66/38 |
| 3,545,233 | 12/1970 | Lombardi | 66/115 X |
| 3,643,472 | 2/1972 | Apprich | 66/115 X |
| 3,817,058 | 6/1974 | Lombardi | 66/115 X |
| 3,852,979 | 12/1974 | Muhlhausler | 66/115 |

FOREIGN PATENT DOCUMENTS

| | | | |
|---|---|---|---|
| 2,098,770 | 7/1970 | France | 66/115 |
| 665,492 | 6/1964 | Italy | 66/115 |
| 723,302 | 2/1955 | United Kingdom | 66/115 |
| 593,490 | 10/1947 | United Kingdom | 66/115 |

*Primary Examiner*—Mervin Stein
*Assistant Examiner*—Andrew M. Falik
*Attorney, Agent, or Firm*—Allison C. Collard

[57] ABSTRACT

A device for supporting and guiding knitting needles for use in a knitting machine having a needle bed with needle grooves for receiving the stems of knitting needles and to guide advance and retraction movements of the needles. The needle grooves are arranged side-by-side and provided in two rows in the front and rear regions of the needle bed respectively with respect to the direction of the advance and retraction movements. The needle grooves in one of the regions are out of alignment with the needle grooves in the other region and offset in a direction perpendicular to the direction of the movement. The stems of the knitting needles are alternately insertable in the needle grooves of the two regions. The knitting needles insertable in the needle grooves of the rear region when in a position of use extend over the surfaces of the walls between the needle grooves of the front region. A recess is provided in the bed on the inner and outer sides of at least the front grooved region.

7 Claims, 13 Drawing Figures

DEVICE FOR SUPPORTING AND GUIDING KNITTING NEEDLES FOR KNITTING MACHINES

The present invention relates to a device for supporting and guiding knitting needles for knitting machines.

In order to knit a fabric having a high wale density and fine and compact structure on a knitting machine, it is necessary to reduce the pitch arrangement of the knitting needles on the needle bed. With conventional knitting machines, the needle grooves receiving and slidably guiding the shanks or stems of the knitting needles are all formed in the same area of the needle bed surface and arranged side by side in a row, so that the thickness of the walls between the needle grooves is reduced in proportion to the decrease in the pitch of the needle arrangement. Since the walls between the needle grooves must not bend or fracture upon impact thereagainst of needle stems which are inclined sidewise by the force of needle operating cam means, the reduction in the wall thickness, namely the reduction in the pitch of needle groove arrangement, is inherently limited. The reduction in the pitch of needle grooves is more severely limited in needle beds of the dial type in which the needle grooves are radially arranged, because the thickness of the walls between the grooves progressively decreases from the outer end thereof toward the rear or inner end.

Accordingly, it has been impossible to knit fabrics of very fine structure and texture on conventional knitting machines.

It is an object of the present invention to provide a device for supporting knitting needles for knitting high quality fabrics having a finer structure and texture than is available with conventional knitting machines.

The present invention provides a device for supporting and guiding knitting needles for use in a knitting machine. The device has a needle bed with needle grooves for receiving the stems of the knitting needles, and to guide the advance and retraction movements of the needles. The needle grooves are arranged side-by-side and provided in two rows in the front and rear regions of the needle bed respectively with respect to the direction of the advance and retraction movements. The needle grooves in one of the regions are out of alignment with the needle grooves in the other region, and offset in a direction perpendicular to the direction of the movement. The stems of the knitting needles are alternately insertable in the needle grooves of the two regions. The knitting needles that are insertable in the needle grooves of the rear region when in a position of use, extend over the surfaces of the walls between the needle grooves of the front region. A recess is preferably provided in the bed on the inner and outer sides of at least the front grooved region.

Furthermore, the needle bed is preferably annular and the rear, grooved region is provided as an integral portion of the bed. An annular insert forms the front, grooved region and is secured in a recess of the bed. When the bed is of the cylindrical type, it preferably has retention means provided rearwardly of the front portion for engagement with the needles sliding in the grooves thereof, to prevent dislodgement when not acted on by a raising cam of the knitting machine.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 1:
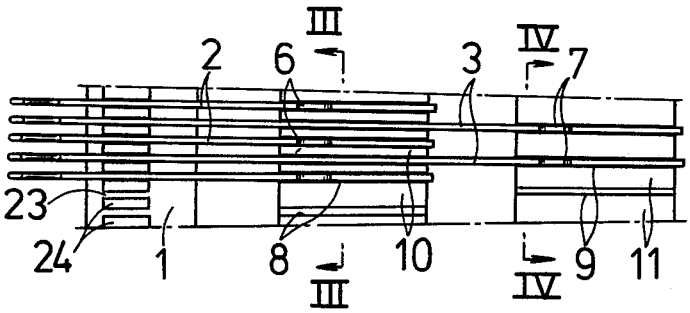
FIG. 1 is a plan view of a first embodiment having dial-type needle bed for a knitting machine.
Figure 2:
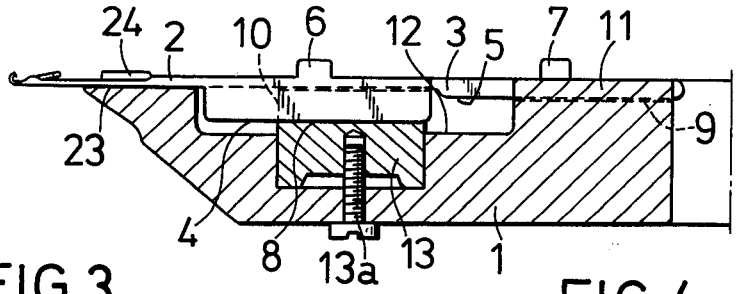
FIG. 2 is a cross-sectional view of the needle bed of FIG. 1 taken in the longitudinal direction of the short knitting needles.
Figure 3:
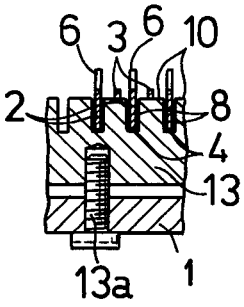
FIGS. 3 and 4 are cross-sectional views taken along lines III—III and IV—IV respectively of FIG. 1.
Figure 4:
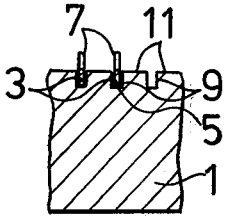
Figure 5A:
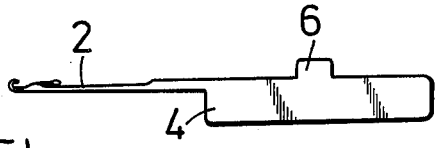
Figure 5B:
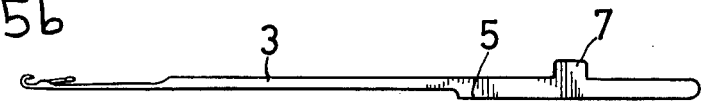
Figure 6:
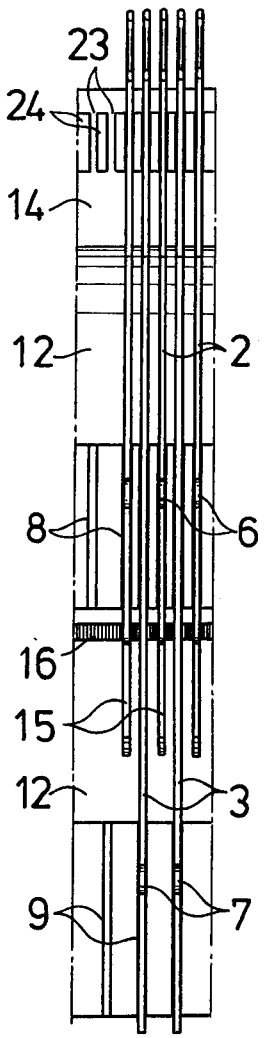
Figure 7:
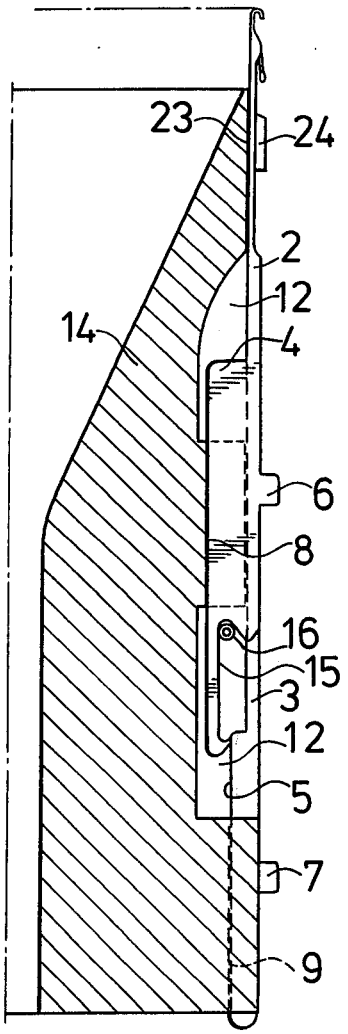
Figure 8:
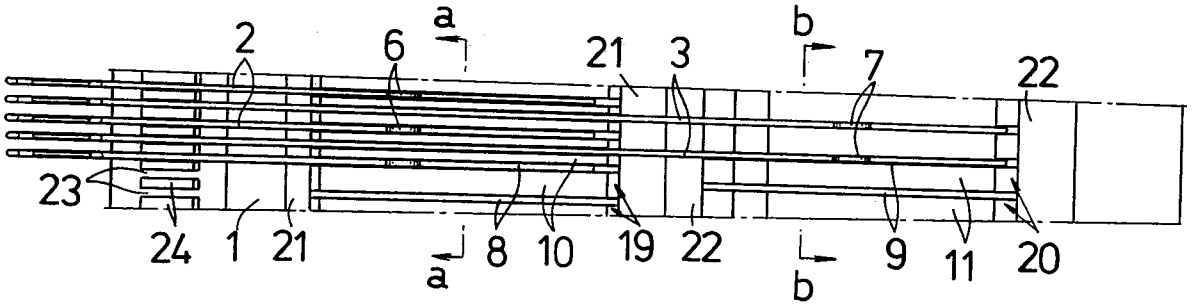
Figure 9:
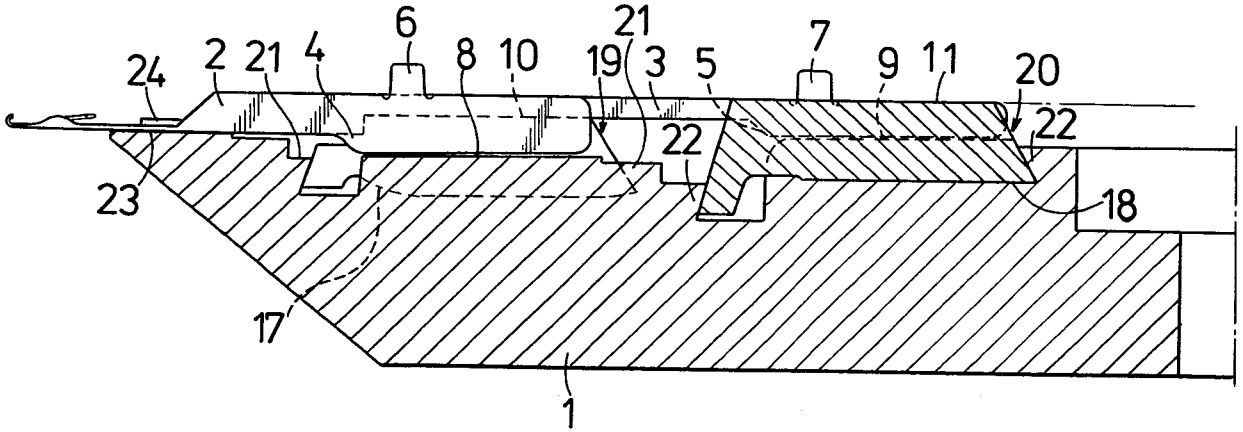
Figure 10:
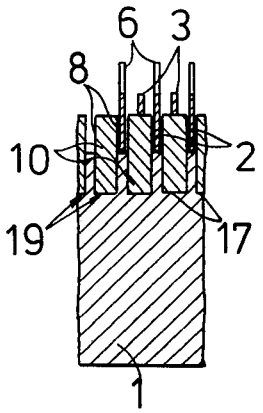
Figure 11:
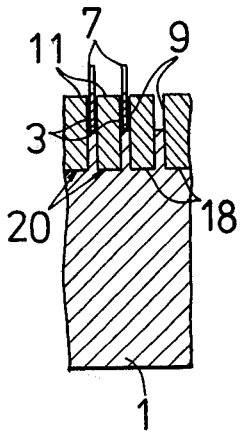
Figure 12:
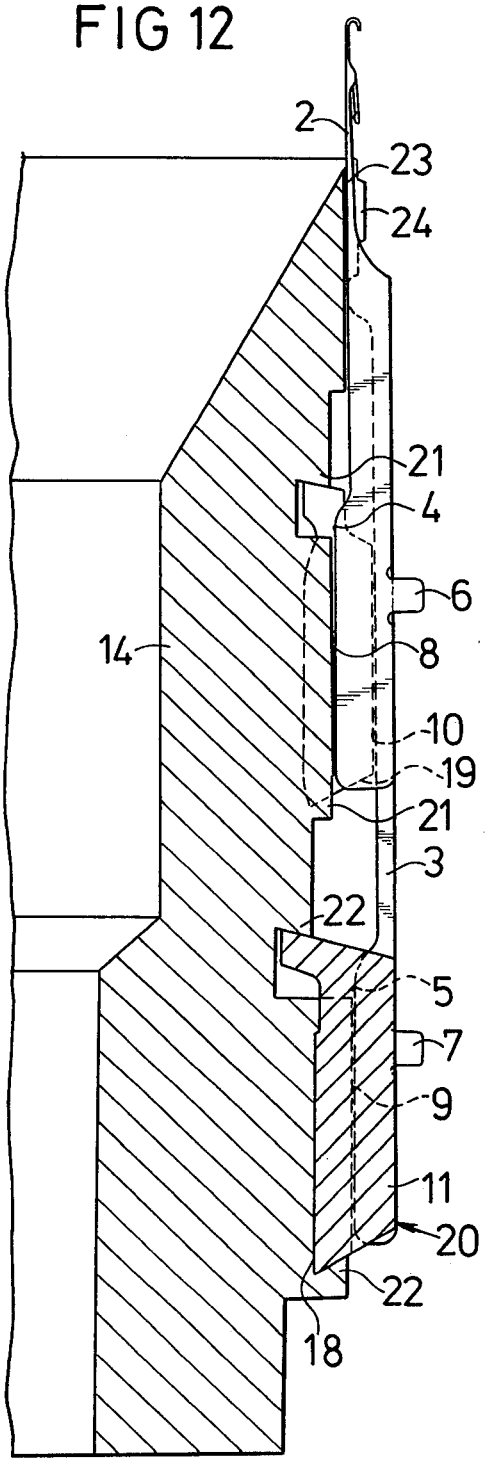

FIGS. 5*a* and 5*b* are side elevation views of a short knitting needle and a long knitting needle respectively;

FIG. 6 is a front view of a second embodiment having cylinder-type needle bed for the knitting machine;

FIG. 7 is a cross-sectional view along a short knitting needle of the embodiment of FIG. 6;

FIG. 8 is a plan view of a third embodiment of a dial-type needle bed;

FIG. 9 is a view in section taken along the longitudinal direction of a short knitting needle of the embodiment of FIG. 9;

FIGS. 10 and 11 are sectional views taken along lines *a—a* and *b—b* respectively of FIG. 8; and FIG. 12 is a sectional view taken along the longitudinal direction of a short knitting needle showing a fourth embodiment of the invention as applied to the cylindrical-type needle bed.

In FIGS. 1 to 5, a first embodiment of the invention is illustrated as applied to a disc or dial-type needle bed for a circular, rib knitting machine.

In FIGS. 1 to 4, a portion of a needle bed 1 of the disc or dial type is illustrated and has short knitting needles 2 and long knitting needles 3. The short and long knitting needles are alternately arranged side-by-side on bed 1. Long needles 3 extend rearward beyond the tail ends of short needles 2. Inserting portions 4 of short needles 2 are received in needle grooves and each portion projects from the bottom of the rear half of the needle shank or stem. Inserting portions 5 of long needles 3 are received in needle grooves, and each portion 5 projects from the bottom of the part of needle 3 extending to the rear of the tail end of the short needle 2. Butts 6 and 7 of needles 2 and 3 respectively are provided on the opposite side of inserting portions 4 and 5. Needle bed 1 has formed in its upper surface, needle grooves 8 and 9 for receiving inserting portions 4 and 5 of knitting needles 2 and 3. The grooves are formed in two regions, i.e. front and rear regions, corresponding to the positions of inserting portions 4 and 5 respectively. The grooves are arranged side-by-side in two rows and the grooves in one row are out of alignment with those in the other row, as deviated in a direction perpendicular to the direction of movement of needles 2 and 3. The portion of long needle 2 to the front of inserting portion 5 of its stem extends over the ungrooved surface of a wall 10 between needle grooves 8 for short needles 2.

With the construction described, each of walls 10 and 11 defining the needle grooves in the front and rear regions has a thickness at least twice as large as the thickness of the walls which define needle grooves 8 and 9, when they are formed in the same region as arranged side-by-side in a row. Thus the wall has sufficiently increased strength to resist any lateral pressure.

Because inserting portions 4 and 5 of the two types of needles 2 and 3 project from the bottom of the needle stems, needles 2 and 3 and butts 6 and 7 are positioned at the same levels respectively when seen in a front view, so that cam means for butts 6 and 7 can be readily provided with a stable arrangement. A recess 12 is formed in the surface of needle bed 1 and extends in the direction of rows of knitting needles 2 and 3. An annular steel member 13 has needle grooves 8 formed in its surface for the short needles 2, and is located in recess 12 at an approximately radial midportion of the recess and secured to bed 1 by screws 13*a* screwed into needle bed 1 from the bottom side thereof. Recess 12 is dimensioned so as to permit execution of the stroke of the inserting portion 4 of the short needles. The rear surface of annular member 13 is spaced apart from the inner rear surface defining the recess by a distance permitting advance of the front half of inserting portion 5 of the long needles.

Such combination of recess 12 and annular member 13 is employed because the stroke of sliding portion 4 of the short needle 2 is so small that it is not appropriate to cut needle grooves 8 directly in bed 1. Thus the combination is used for the ease of the machining operation.

In the second embodiment illustrated in FIGS. 6 and 7 a portion of cylindrical needle bed (cylinder type) of a circular knitting machine is shown. Short knitting needles 2 and long knitting needles 3 are arranged alternately on the peripheral surface of the cylindrical needle bed 14. Needles 2 and 3 are provided on the bottom side thereof with inserting portions 4 and 5 received in needle grooves 8 and 9 which are arranged side-by-side in two rows respectively located in two divided regions, i.e. high and low regions, of needle bed 14. The grooves in one region are deviated circumferentially of needle bed 14, from those in the other region. The stems of long needles 3 extend over the ungrooved surface of needle bed 14 in the area where needle grooves 8 are formed side-by-side. Consequently, the width, namely thickness, of walls 10 and 11 between the grooves in the high and low positions is at least twice the distance between the two types of needles 2 and 3. In respect of these features, the second embodiment has substantially the same construction as the first.

However, the grooved regions for grooves 8 and 9 are referred to as high and low since needle bed 14 is of the vertical type. Furthermore, needle grooves 8 for short needles 2, like needle grooves 9 for long needles 3, are formed in needle bed 14 itself. Above and below needle grooves 8, needle bed 14 has recesses 12 into which inserting portions 4 and 5 of needles 2 and 3 are allowed to partially extend. Since the length of cylindrical needle bed 14 in the direction of the vertical movement of the needles is greater than the corresponding length of needle bed 1 of the dial type, recesses 12, 12 in the high and low positions can be individually machined by a cutter. Annular member 13 used in dial needle bed 1 is not necessary.

Short needle 2 has an elongated hooked bar 15 extending downward from the lower end of its inserting portion 4 into the recess 12. A coiled spring 16 extends around the row of hooked bars to bind them together. Short needles 2, with their lower ends positioned in recessed space 12, tend to fall under gravity when they are free of the action of a raising cam (not shown) and its coiled spring 16 serves to restrict this action.

In a third embodiment illustrated in FIGS. 8 to 11, a disc-type or dial-type needle bed is illustrated constructed in accordance with the invention.

A disc-type needle bed 1 has short knitting needles 2, long knitting needles 3, inserting portions 4 of short needles 2, inserting portions 5 of long needles 3, butts 6 and 7 of the two types of needles 2 and 3 respectively, needle grooves 8 for short needles 2, walls 10 defining the grooves, needle grooves 9 for the long needles 3, and walls 11 defining the grooves.

The stems of long needles 3 extend over the ungrooved surfaces of walls 10.

Needle grooves 8 and 9 and walls 10 and 11 between the grooves are formed by cutting grooves 17 and 18 side-by-side in the surface of needle bed 1, fitting steel pieces 19 and 20 into grooves 17 and 18 each to one half the height of the piece, and caulking the joints between the front and rear ends of each piece and edges 21 and 22 of needle bed 1 to secure the pieces to the bed. Apart from this feature, this third embodiment has the same construction as the first.

A fourth embodiment is illustrated in FIG. 12 and has the same construction as the third embodiment (as shown in FIGS. 8 to 11) except that a cylindrical needle bed 14 is used in place of the disc-like needle bed 1 of the third embodiment.

In a fifth embodiment (not specifically illustrated) of a circular rib knitting machine is equipped with a cylinder type needle bed 14 and a dial type needle bed 1, in other words as the invention is embodied as a combination in respect of the cylinder 14 and dial 1 of the knitting machine as described with reference to the first to third embodiments.

Whether the invention is applied to the dial-type needle bed 1 or to cylinder-type needle bed 14, the needle bed, in similar manner to known needle beds, is provided with needle grooves 23 each receiving the front end of one of needles 2 and 3 and walls 24 defining needle grooves 23, the grooves and walls being arranged side-by-side in a row at the front end of the needle bed surface where the needles 2 and 3 draw yarns into loops.

The thickness of walls 24 between the grooves corresponds to the distance between adjacent needles 2 and 3, and is very small when needles 2 and 3 are arranged at a small pitch on the needle bed. However, since the front ends of the needles at this postion are in the form of a round bar and will turn about the needle axes if the needle stems are forced sidewise, without striking walls 24, walls 24 need not have a large thickness.

The present invention enables the walls between needle grooves receiving the entire knitting needles to individually guide the needles for advance and retraction, to have a thickness approximately twice the distance between adjacent needles and therefore such are of greatly increased strength. Thus, even when the knitting needles are arranged at much smaller spacing than in known knitting machines, the walls defining the needle grooves will not tend to be fractured or bent due to the impact of needle stems which are forced sidewise during operation. According to this invention, therefore, it is possible to knit high-quality fabrics having closely arranged wales, a fine, compact and strong structure, and an attractive appearance which are not available with known knitting machines.

While only a few embodiments of the present invention have been shown and described, it will be obvious to those skilled in the art that many modifications and changes may be made thereunto without departing from the spirit and scope of the invention.

What is claimed is:

1. A device for supporting and guiding knitting needles for use in a knitting machine comprising a needle bed having needle grooves for receiving the stems of knitting needles and to guide advance and retraction movements of the needles, the needle grooves being arranged side-by-side and provided in two rows in front and rear regions of the needle bed respectively with respect to the direction of the advance and retraction movements, at least the needle grooves in the front region being interconnected by flat wall surfaces and the needle grooves in one of the regions being out of alignment with the needle grooves in the other region and offset in a direction perpendicular to the direction of the movement, the stems of the knitting needles being alternatively insertable in the needle grooves of the rear region when in a position of use extend over the flat surface of the walls between the needle grooves of the front region.

2. The device as claimed in claim 1 in which a recess is provided in the bed on the inner and outer sides of at least the front grooved region.

3. The device as claimed in claim 2 in which the needle bed is annular and the rear, grooved region provided as an integral portion of the bed, and an annular insert forming the front, grooved region and secured in a recess of the bed.

4. The device as claimed in claim 3 comprising a cylindrical needle bed, and retention means provided rearwardly of the front portion for engagement with the needles sliding in the grooves thereof to prevent dislodgement thereof when not acted on by raising cam of the knitting machine.

5. The device as claimed in claim 4 wherein the needle bed has channels formed therein arranged side-by-side and in two rows in the front and rear regions of the needle bed respectively with respect to the direction of the advance and retraction movements, and said bed additionally includes wall forming pieces having flat upper surfaces which are partially inserted in said channels formed in said bed and which define therebetween said grooves of the front and rear regions.

6. The device as claimed in claim 5 wherein the needles are long and short knitting needles having inserting portions extending from the side of the stem or shank of each needle remote from the side on which the needle butt is located and being inserted in said grooves of the respective regions.

7. The device as claimed in claim 6 wherein the machine is a circular rib knitting machine and includes the combination of a dial needle bed and a cylinder needle bed.

* * * * *